United States Patent [19]

Hasselmann

[11] 3,999,936

[45] Dec. 28, 1976

[54] VAPOR COLLECTION AND DISPOSAL SYSTEM

[76] Inventor: Detlev Edgar Max Hasselmann, 519 S. Nardo, Solana Beach, Calif. 92075

[22] Filed: July 24, 1975

[21] Appl. No.: 598,833

[52] U.S. Cl. ..... 431/202; 23/277 C; 431/5; 431/346

[51] Int. Cl.[2] ..... F23G 7/06

[58] Field of Search ..... 431/5, 202, 78, 80, 431/346; 23/277 C; 220/85 VR, 85 VS

[56] References Cited

UNITED STATES PATENTS

| | | | |
|---|---|---|---|
| 3,213,921 | 10/1965 | Walker et al. | 431/346 |
| 3,817,687 | 6/1974 | Cavellero et al. | 431/202 |
| 3,897,193 | 7/1975 | Kattan et al. | 431/5 |
| 3,914,095 | 10/1975 | Straitz | 431/202 |

*Primary Examiner*—Edward G. Favors
*Attorney, Agent, or Firm*—Brown & Martin

[57] ABSTRACT

In a vapor recovery system, vapors are drawn into a combustible fluid storage tank as the fluid is pumped into a vehicle fuel tank. The storage tank need not have provision for the aspiration of a carrier gas to remove the vapors. At a threshold pressure, a pressure sensing switch is tripped to pass vapors to a combustion chamber. An ignitor ignites the delivered vapors. A flame detector senses the presence of burning gases. A relay is responsive to the flame detector and latchs open a timing mechanism. If no flame is detected, the timing mechanism causes an interruption in the flow of vapors. A flame arrestor prevents a flame flashback in the vapor line. A temperature sensing switch interrupts the flow of vapors in the event it senses flame flashback. An auxiliary disposal circuit is operable to process high pressure vapors due to storage tank refilling.

11 Claims, 5 Drawing Figures

VAPOR COLLECTION AND DISPOSAL SYSTEM

BACKGROUND OF THE INVENTION

As part of a program to improve air quality standards, attempts have been made to control vapor emissions at gasoline service stations. Gasoline vapors commonly consist of photochemically reactive hydrocarbons. They react with oxides of nitrogen such as nitrous-oxide in the presence of sunlight to create smog. Tests indicate that approximately 4 grams of vapor are emitted for every gallon of gasoline deposited in a vehicle gasoline tank. Proportional amounts of vapor are released when the underground storage tank is refilled.

During the refueling of an automobile fuel tank, the vapors in the fuel tank are displaced as gasoline fills the tank volume. These vapors may be drawn from the fuel tank and delivered to the storage tank from which the gasoline is pumped. A suction blower has been utilized to accomplish this function.

Leaks, vents, and loose fittings have allowed excess air or vapors to be drawn into the storage tank. These cause a larger than necessary vapor volume to be transferred to the storage tank. The excess vapors must be released to prevent excessive pressurization of the storage tank.

Prior efforts to dissipate the excess pressure in the storage tanks have met with only limited success. The simplest process is known as the "balanced" system. It consists of a special nozzle and an ordinary underground piping. The automobile tank and the underground storage tank exchange vapor volume for liquid volume. Excess vapors generated by temperature variations, liquid traps, spit-back from vehicle tanks, pipe restrictions, and poor fits at the vehicle tank nozzle interface cause the balanced system to be very inefficient.

Attempts have been made to improve the efficiency of the balanced system by developing various "secondary" or "vacuum assist" systems. The secondary systems utilize a small vacuum pump to draw the vapors from the vehicle tank spout. The vapors are then processsed by refrigeration/condensation, catalytic oxidation, or incineration. Adsorption of the vapors on activated carbon beds is another method that has been tried. The carbon beds are regenerated by the reverse flow of air. These systems experience many serious deficiencies. Refrigeration/condensation is only advantageous for bulk storage facilities or stations pumping on the order of 100,000 gallons per month. Furthermore, they require cumbersome and costly refrigeration equipment for condensation. These units are also wasteful from a standpoint of energy conservation.

Yet another system that has been tried operates on the principle of converting hydrocarbon vapors to carbon dioxide and water vapor. These systems utilize a platinum or other noble metal catalyst for oxidation. The control of reactive temperatures is critical. Above 1200° F, the life of the catalyst is greatly reduced. Below 900° F, the conversion efficiency drops rapidly. To minimize the size of the reactor system, carbon absorption beds are used for intermediate storage of vapors. The activated carbon beds smooth out the large flow during vehicle refueling and permit slow regeneration over a period of time. However, the carbon beds are not completely effective. The lighter hydrocarbons fractions, such as methane or ethane are not readily absorbed and pass through the carbon beds without being captured. The heavier fractions, such as hexane or heptane are readily absorbed but are also difficult to desorb. They tend to remain after bed stripping and decrease the ability of the carbon bed to absorb subsequent vapors.

Another approach utilizes incineration to burn off the vapors. This method is also plunged with many problems. The flow of vapors is variable depending upon the number of vehicles refueled in a given period of time. The concentrations of hydrocarbons in the vapors varies greatly. Specifcially, the concentration is sometimes insufficient to support combustion and excess air causes the flame to extinguish. Also, a concentration that is too high will cause incomplete combustion with the by products thereof being released to the atmosphere. Several incineration systems have attempted, with little success, to solve these problems. One system utilizes carbon beds as a strong medium. Desorption of the hydrocarbons is made at a specified rate to control the combustion process. In this system, the inherent problems of utilizing carbon beds is similar to those previously described. Furthermore, the system wastes energy since the blower must be used during the desorption cycle. Another system burns the vapors in a continuous furnace. This system requires additional fuel to maintain the furnace flame. Other systems use air ejectors to scavenge vapors from the underground tank. The fixed flow ejector cycles on and off to maintain a fixed vacuum in the underground storage tank. This system causes unnecessary boil-off of gasoline.

Still other problems associated with any and all of the aforementioned systems concern bulk deliveries made to service stations. In the fall, it is common for gasoline manufacturers to switch to higher volatility gasoline. This improves low temperature performance in automobiles. When this higher volatility gasoline is dropped on top of older gasoline, excess vapors are created. The prior art systems are not capable of processing this large volume of excess vapor.

Therefore, there has been a need for the development of a system that safely and efficiently collects and disposes of hydrocarbon vapors. Some of the characteristics of an efficiently operated system should include the elimination of auxiliary blowers and carbon canisters, the prevention of cracks or leaks in the system by maintaining low pressure in the piping and the storage tank, the utilization of excess pressure in the tank as the driving force for the discharge of vapors therefrom, the burning of vapors in ambient atmosphere, effective monitoring of the system and interrupting the system in the event of operating abnormalities.

SUMMARY OF THE INVENTION

The instant invention concerns a system for collecting and processing combustible vapors. While it will be described in conjunction with the collection and processing of gasoline vapors at service stations, it should be recognized that it may be utilized whenever combustible vapors must be prevented from being released to the environment.

As fuel is withdrawn from a storage tank and injected into an automobile fuel tank, a vacuum blower draws the vapors from the fuel tank and delivers them to the storage tank. A flow control valve insures that vapors are withdrawn from the fuel tank only as the fuel is being injected. Vapors are generated only when automobiles are being refueled. Normal fill rates average around 8 gallons per minute, or about 1 cubic foot per minute. The excess vapors drawn into the underground tank average around one-third to one-half cubic foot per minute. The underground storage tank is used as a low pressure accumulator. Since these tanks have a storage capacity on the order of 1,000 cubic feet, there is sufficient capacity to temporarily store recovered vapors. The increase in storage tank pressure might be on the order of 2 to 3 inches water column or about 0.07 to 0.11 psi. These pressures are released over several minutes so that increased pressures due to intermittent fueling can be gradually reduced Thus, when only one automobile is being refueled, the tank pressure is low and a low flow rate of vapors is required. When several automobiles are being refueled, the storage pressure will rise, and the release of vapors should be greater. However, the discharge rate is slower than the storage tank fill rate, so as to have a continuous discharge to avoid creating a periodically heavy load on the system.

Pressing sensing means, in the form of a pressure sensitive switch, is tripped when the pressure in the storage tank is on the order of ½ to 1 inch circuit to a solenoid valve means that in response opens to release vapors from the storage tank. Flow regulating means in the form of a pressure regulator and an orifice plate, meter the vapors discharged from the storage tank. The discharged vapors are delivered to a disposal means, in the form of combustion chamber means that burns them off in the presence of large quantities of ambient air. Flame arresting means, comprising a perforated plate in the vapor line, prevents flame flashback into the vapor line. Flame flashback is also inhibited by the use of tubing and burner jets on the order of ⅛orifice diameter. Jets of this size minimize the pressure drop but are small enough to prevent flashback when vapors emanating from the system are in combustible range. The combustion chamber means is a venturi shaped flue. The burner jets are situated in general registration with the neck of the venturi. As the vapors are burned off, large quantities of ambient air are aspirated through the lower part of the flue to insure complete combustion at the burner jets. To keep the flame from blowing out, a stainless steel screen is suspended above the burner jets. In the event some operating abnormality is encountered, a normally closed temperature sensing means or switch is disposed in the vicinity of the combustion chamber to detect any possible flame flashback. In the event flame flashback is encountered, the temperature sensing switch opens and breaks the circuit to the solenoid valve, and no additional vapors will be discharged from the system. When the pressure sensing switch is closed, an ignitor is energized and provides the spark to light the burner jets. Flame detector means are concurrently energized with the ignitor and sense the presence of a flame. At the same time interruptor means, such as a timer, is activated and it is pre-set to time out a certain interval in which the flame detector must detect the presence of a flame. In the event that no flame is detected during that pre-set interval, the timer opens a timing switch that breaks the circuit to the solenoid valve to interrupt vapor flow. If a flame is detected, the signal from the flame detector is amplified and a responsive means in the form of a relay is energized to open a relay switch. The relay switch breaks the circuit to the timer deactivating that function. Therefore, if a flame is detected, the timer is deactivated and will not trip-out the solenoid valve.

An auxiliary vapor collection and disposal means is incorporated to accommodate high vapor pressures that may be due to circumstances such as fall changeover. This auxiliary means essentially duplicates some of the structure previously described. An auxiliary pressure sensing switch is designed to operate at a predetermined pressure above that necessary to operate the pressure sensing switch. Closing of the auxiliary pressure sensing switch activates an auxiliary solenoid valve that directs flow into an auxiliary pressure regulator and orifice plate to regulate the flow of vapors through parallel piping. Another flame arrestor is included to prevent flame flashback through the parallel piping. An auxiliary set of burner jets are supported in the combustion chamber adjacent the first set of burner jets. To provide further assurance against operating abnormalities, an auxiliary temperature sensing switch is situated in the vicinity of the combustion chamber and is branched in series with the first temperature sensing switch. In the event flame flashback is encountered, the auxiliary temperature sensing switch opens and interrupts the circuit to the first solenoid valve. This has the effect of discontinuing all vapor flow through the system until the problem has been remedied. The flame detector, relay and timer function as previously described, except that if no flame is detected at the first burner jets the relay opens the line to the auxiliary pressure switch. This shuts the auxiliary solenoid valve to interrupt high pressure flow.

To insure against an unusually high pressure concentration due to abnormal circumstances, an emergency vent valve may be provided to vent vapors from the storage tank directly to the atmosphere.

It is therefore an object of the invention to provide a new and improved vapor collection and disposal system.

Another object of the invention is to provide a new and improved vapor collection and disposal system that provides for complete combustion of vapors without polluting by-products.

Another object of the invention is to provide a new and improved vapor collection and disposal system in which the vapors are vented by tank pressure only and no auxiliary blower is required.

Another object of the invention is to provide a new and improved vapor collection and disposal system that operates on low pressure to prevent cracks or leaks.

Another object of the invention is to provide a new and improved vapor collection and disposal system that requires no auxiliary storage apparatus.

Another object of the invention is to provide a new and improved vapor collection and disposal system that applies no suction on the storage tank so that no ambient air is aspirated into the tank.

Another object of the invention is to provide a new and improved vapor collection and disposal system in which combustion takes place at low temperature conditions.

Another object of the invention is to provide a new and improved vapor collection and disposal system that vents vapors gradually even if the vapor pressure intermittently accumulates.

Another object of the invention is to provide a new and improved vapor collection and disposal system in which the vapor concentration is not critical.

Another object of the invention is to provide a new and improved vapor collection and disposal system that is monitored for automatic shutdown if abnormal operation is encountered.

Another object of the invention is to provide a new and improved vapor collection and disposal system that is pre-set to interrupt vapor flow if no burn off is sensed.

Another object of the invention is to provide a new and improved vapor collection and disposal system that arrests flame flashback into the vapor line.

Another object of the invention is to provide a new and improved vapor collection and disposal system that vents substantial excess pressure to the air in the event of unusual operating abnormalities.

Another object of the invention is to provide a new and improved vapor collection and disposal system that accommodates relatively high vapor pressure due to seasonal fuel changeover.

Another object of the invention is to provide a new and improved vapor collection and disposal system that utilizes little external energy and operates in an on-demand condition.

Another object of the invention is to provide a new and improved vapor collection and disposal system that utilizes the increase in vapor pressure to cause vapor disposal.

Another object of the invention is to provide a new and improved vapor collection and disposal system that provides consistent vapor concentration for efficient operation.

Another object of the invention is to provide a new and improved vapor collection and disposal system in which the vapor concentration is well above the flamability limit in all the vapor lines and only reaches the flamability limit after leaving the burner jets.

Another object of the invention is to provide a new and improved vapor collection and disposal system that is durable, simply constructed, efficient and easy to install.

The above and other objects of the invention will be apparent as the description continues and when read in conjunction with the drawings in which like reference numerals refer to like parts throughout and in which.

DETAILED DESCRIPTION OF THE DRAWINGS

Figure 1:
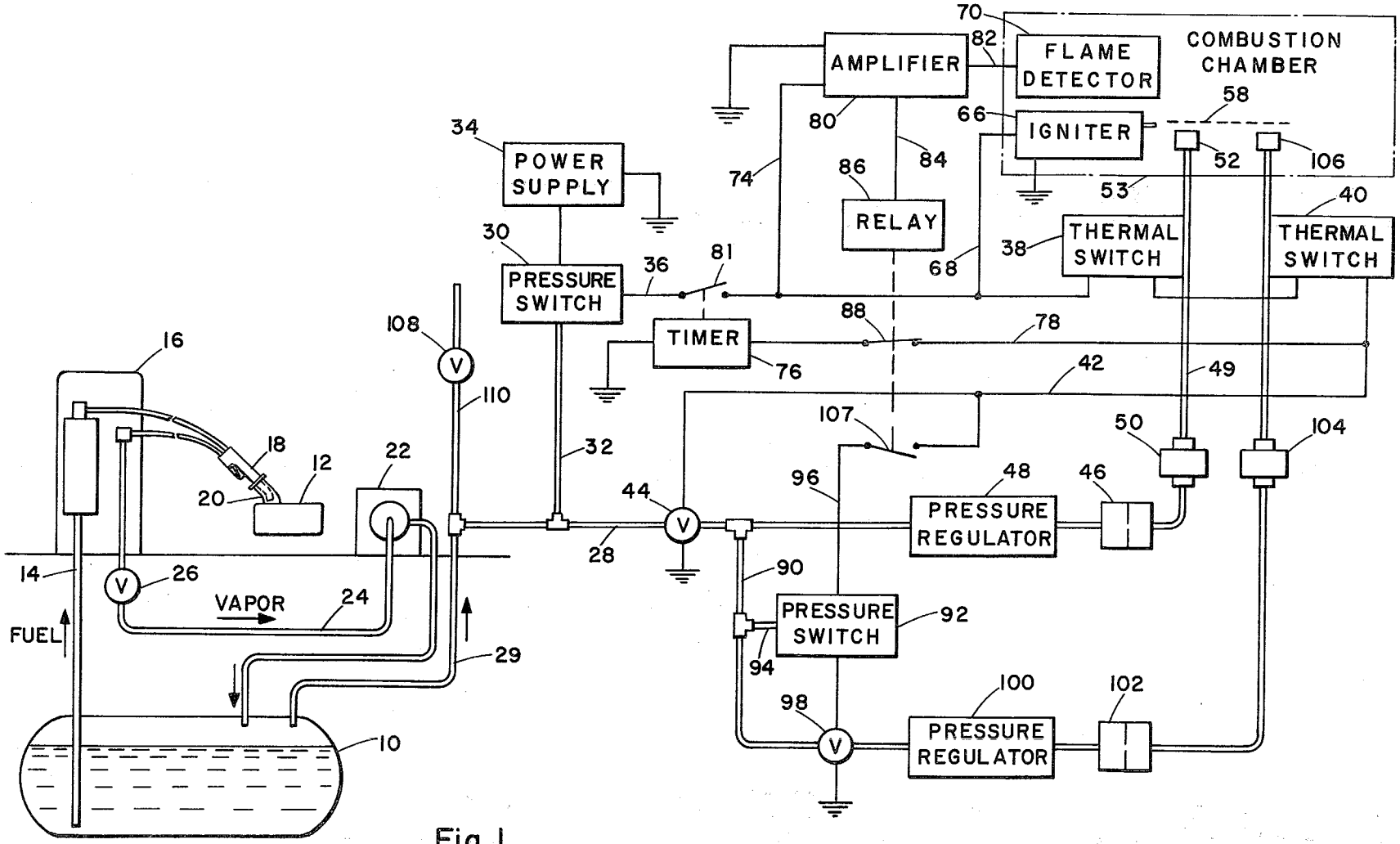
FIG. 1 is a diagram of the complete system.
Figure 2:
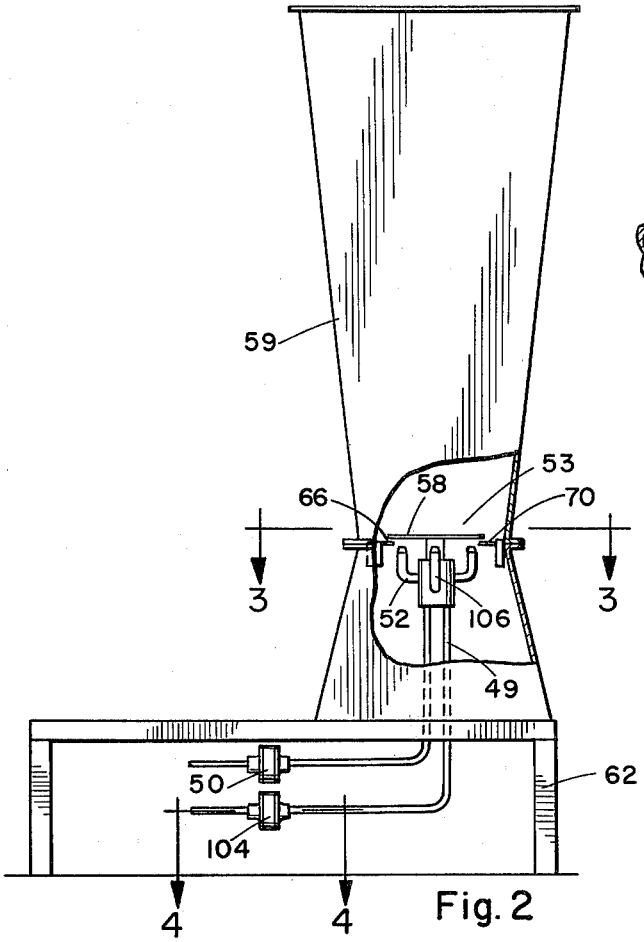
FIG. 2 is a side elevation view, partially cut away, of the combustion unit.
Figure 4:
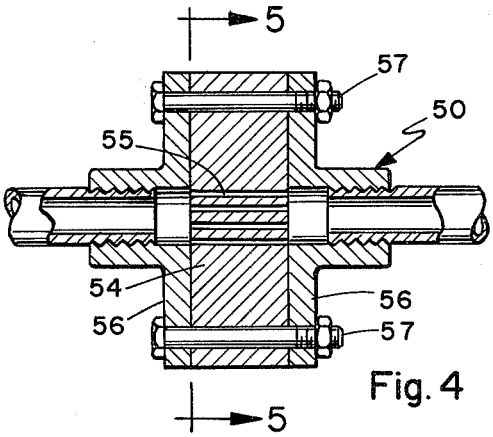
FIG. 4 is an enlarged sectional view taken on line 4—4 of FIG. 2.
Figure 5:
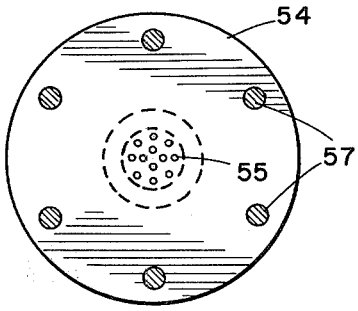
FIG. 5 is a sectional view taken on line 5—5 of FIG. 4.
Figure 3:
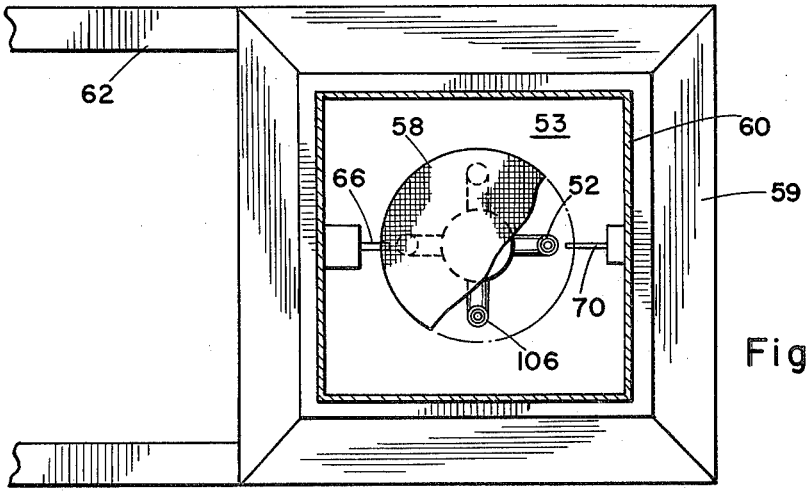
FIG. 3 is an enlarged sectional view taken on line 3—3 of FIG. 2.

The invention is associated with a conventional gasoline storage tank 10. Fuel is pumped into a fuel tank 12 through the line 14 by means of pump 16. The fuel dispensing nozzle 18 may be fitted with a loose fitting boot or cuff 20 to capture vapors displaced from the fuel tank 12. A tight fit to the vehicle fuel tank 12 is not required, and some ambient air is drawn in along with the gasoline vapors. A blower 22 creates a suction in the return pipe 24 and vapors are sucked from the fuel tank 12 into the storage tank 10 to replace the volume of fuel discharged therefrom. A flow control valve 26 is disposed in pipe 24. The flow control valve 26 functions to limit the flow of vapors during the period when fuel is not being injected into the fuel tank 12. When the flow of gasoline in pipe 14 is interrupted, the flow of vapors in the return pipe 24 is interrupted. The arrangement of a loose fitting boot 20 and the flow control valve 26 results in excess vapor ingestion of between 30 to 50 percent.

Temperature differentials between the underground storage tank 10 and the fuel tank 12, differences in volatility between fresh and old fuel, and ingestion of air at the nozzle interface cause excess vapor volumes to be returned to the storage tank 10. The excess vapors must be disposed of to prevent over-pressurization of the storage tank 10. Accordingly, a piping system 28 has a branch 29 that registers with the upper, vapor occupied volume of the storage tank 10. A pressure sensitive switch 30 via pipe 32 is sensitive to the vapor pressure in storage tank 10. Upon the attaining of approximately ½ to 1 inch water column pressure above ambient, the vapor pressure closes the pressure sensitive switch 30. The pressure sensitive switch 30 is disposed in electrical line 36 and is connected to an electrical power source 34. This causes current to pass through line 36 and the normally closed temperature sensing switches 38 and 40 to line 42. Line 42 enables the solenoid valve 44 that opens to pass vapors from the upstream side of piping system 28 to the downstream side thereof. The flow of vapors through the piping system 28 is dependent upon the pressure in storage tank 10. The vapor flow is controlled by an orifice plate 46. Typically, an orifice plate with three ⅛ inch diameter holes is used. This limits the flow to about ½ inch cfm at ½ inch water column, and rises to about 1½ inches cfm at 4½ inches water column. The maximinum flow of 1½ inches cfm is set by pressure regulator 48 that is disposed in the piping system 28 upstream of the orifice plate 46. The pressure regulator 48 limits the pressure at the orifice plate 46 inlet to 4½ inches water column.

The vapor flows in the piping system 28 past a flame arrestor 50 and into the burner jets 52 in the combustion chamber 53. The tubing to the burner jets 52 and the jet orifices in this exemplary embodiment, have been chosen with ⅛ inch diameter. It has been found that they are large enough to minimize pressure drop, but also small enough to prevent flame flashback into the piping system 28 when the vapors emanating from the system are in the combustible range. The flame arrestor 50 provides further assurance against flame flashback. In an exemplary embodiment, the flame arrestor comprises a barrier plate 54 such as a copper disc. On the order of twelve holes, each ⅛ inch in diameter, are formed in the center ¾ inch of the plate 54. The plate 54 is then fastened in the connector 56 by means of bolts 57 and it is assembled in the piping system 28. The flame arrestor 50 accomplishes its function by absorbing the shock front and dissipating the thermal energy via its mass and heat conducting properties. The shock front from explosion is broken up by the barrier presented by the flame arrestor 50. Flames are prevented from passing through the flame arrestor 50 because of the cooling effect of the barrier 54. Without heat, the flame cannot sustain itself. The heat is withdrawn from the flame front by the mass of the barrier 54 and by heat transmission from the barrier surroundings.

From the flame arrestor, the vapors pass into the tubing 49 and then into the burner jets 52. A stainless steel screen 58 is supported above the burner jets to prevent draft air from blowing the flame out. The combustion chamber 53 is designed as a venturi shaped flue 59 having a neck 60. The burner jets 52 are supported generally in the plane of the neck 60. The combustion chamber 53 is supported on a platform 62 to permit aspiration of large quantities of ambient air through its open bottom. The vapor concentration in the piping system 28 is generally well above the flamability limit so that combustion within the piping system 28 cannot be supported. The flamability limit is reached as the vapors leave the burner jets 52. The large amounts of aspirated air permit complete combustion of the vapors insuring that no pollutants are discharged into the atmosphere. Furthermore, the combustion gases expand as they rise, thus creating additional updraft forces. These updrafts aspirate more ambient air to provide such complete combustion that there is substantially no soot formed.

When the pressure sensing switch 30 is closed, an ignitor 66 is energized via line 68. The ignitor 68 creates a spark in the vicinity of the burner jets 52. To make certain that the system is functioning normally, a flame detector 70 is supported so that it can sense the presence of flames in the combustion chamber 53. Concurrently with the energizing of the ignitor 66, a timer 76 is also energized via line 78. The timer 76 is designed to open the timing switch 81 after a certain predetermined time interval. It is seen that opening the timing switch 81 will break the circuit to the solenoid valve 44 and consequently interrupt the flow of vapors in the piping system 28. The timer 76 is designed to perform its function only if no flame is detected by the flame detector 70. Accordingly, if flames are sensed, amplifier 80 is energized via line 74 and applies a signal via line 84 to a relay 86. Relay 86 is energized to latch open a relay switch 88 that is disposed in line 78. If the switch 88 is opened, it should be clear that the timer 76 is deactivated and will not trip-out the timer switch 81. Therefore, if a flame is detected by flame detector 70, the switch 88 is opened and the switch 81 remains closd, and solenoid valve 44 remains open to pass vapors from the storage tank 10. In the event of some unusual operating conditions and some flame flashback is sensed, the temperature sensing switch 38 that is normally closed in line 36 opens to break the circuit to the solenoid valve 44. As previously stated, this will interrupt the flow of vapors and protect the system from potentially explosive conditions.

At certain times pressures in excess of those accommodated by the pressure regulator 48 and orifice plate 46 are experienced, primarily due to changes in seasons when the gasoline manufacturers switch to a higher volatility gasoline. When the higher volatility gasoline is dropped on top of older gasoline, excess vapors are created. For this reason, a high flow condition is built into this system. Accordingly, an auxiliary piping system 90 directs vapor to a second pressure switch 92 via pipe 94. Upon the attainment of sufficient pressure, the pressure switch 92 closes and via line 96 enables an auxiliary solenoid valve 98. The vapors are then directed through the piping system 90 to the auxiliary pressure regulator 100 and the auxiliary orifice plate 102. Orifice plate 102, in this exemplary embodiment, is provided with three ¼ inch diameter orifices. This limits the flow to 7 cfm at 6 inches water column and rises to 9 cfm at 10 inches water column. An auxiliary flame arrestor 104 is provided in piping system 90 and functions identically as flame arrestor 50. Also, an auxiliary set of burner jets 106 functions identically as the burner jets 52, and is similarly supported in the combustion chamber 53 planar with respect to neck 60. Auxiliary temperature sensing switch 40 functions in association with piping system 90 identically as temperature sensing switch 38. Specifically, if flashback is sensed in piping system 90, the normally closed temperature sensing switch 40 breaks the line 36. If a flame is detected by detector 70, relay 86 is energized and switch 107 is closed. If switch 107 remains open due to no flame detection, then that has the effect of de-energizing solenoid valve 98. The auxiliary system operates only if flame detector 70 senses a flame at burner jets 52. The burner jets 106 do not ignite until flame detector 70 establishes that the burner jets 52 have ignited. Burner jets 106 then vent the gasoline vapors into the flame envelope of burner jets 52. The burner jets 106 have the same finely disbursed gas pattern to permit burning with large quantities of ambient air.

In the unusual event that the system is functioning abnormally so as to cause unusually excessive build up of pressure or vacuum in storage tank 10, a pressure vacuum relief valve 108 is provided in pipe 110 that registers with the vapor occupied section of storage tank 10. The pressure is released by venting the vapors or by breathing air. This is a temporary condition to relieve the danger associated with abnormal pressures, and the valve 108 ceases to function as soon as the system is again operating normally.

The system that has been previously described provides for a gradual release and burn-off of accumulated vapors. For instance, normal fill rates average around 8 gallons per minute, or 1 cubic foot per minute. The excess vapors drawn into the underground storage tank will be in the area of one-third to one-half cubic feet per minute. The combustion chamber 53 is fed vapors at a rate that depends upon the pressure of storage tank 10. Thus, when only one automobile is being refueled, the pressure of storage tank 10 is low and a low flow rate of vapor takes place. When several automobiles are being refueled, the pressures of the storage tank 10 will rise, and the release rate of vapors to the combustion chamber 53 will increase. The discharge rate, nevertheless, is slower than the fill rate of storage tank 10 so as to have a substantially continuous discharge rather than excessively cycling the system on and off. Since the system operates at relatively low pressures, leaks through piping cracks or relief vents are prevented. The design also separates the processing of vapors from automobile refueling with those from bulk drops. This optimizes the design of the low flow burner jets 52 for maximum safety. The system is compact and efficiently constructed and may be stacked in parallel for larger installations. Furthermore, since the burning is so effectively monitored, fire and explosion hazards are greatly reduced.

Having described my invention, I now claim:

1. A pressure sensitive vapor collection and disposal system for use with a storage tank containing combustible material comprising:

pressure sensing means normally in a first position until the vapor pressure in the storage tank reaches a threshold pressure at which pressure said pressure sensing means is moved by the vapor pressure to a second position, valve means in communication with the tank and operable when said pressure sensing means is in its second position to pass vapors from the tank, whereby the vapor pressure in the storage tank causes the vapor discharge without assistance from an aspirated carrier gas, disposal means in communication with said valve means and operable to dispose of the vapors passed thereto by said valve means, an auxiliary vapor collection and disposal means operable at a preset threshold pressure above that active to move said pressure sensing means to said second position and operable after said pressure sensing means is moved to its second position, said auxiliary means comprising an auxiliary pressure sensing means normally in a first position until the vapor pressure reaches a preset threshhold pressure above that active to move said pressure sensing means to its second position, said auxiliary pressure sensing means being moved by the vapor pressure to a second position, auxiliary valve means in communication with the tank and operable when said auxiliary pressure sensing means is in its second position to pass vapors from the tank.

2. The system of claim 1 including:

flow regulating means disposed between said valve means and the tank, said flow regulating means adapted for metering the flow rate of the vapors to said disposal means providing a controlled rate disposition of said vapors.

3. The system of claim 1 wherein:

said disposal means comprises combustion chamber means wherein the discharged vapors are burned off.

and including flame arresting means disposed between the tank and said valve means for preventing flame flashback toward the tank.

4. A pressure sensitive vapor collection and disposal system for use with a storage tank containing combustible material comprising:

pressure sensing means normally in a first position until the vapor pressure in the storage tank reaches a threshold pressure at which pressure said pressure sensing means is moved by the vapor pressure to a second position, valve means in communication with the tank and operable when said pressure sensing means is in its second position to pass vapors from the tank, whereby the vapor pressure in the storage tank causes the vapor discharge without assistance from an aspirated carrier gas, disposal means in communication with said valve means and operable to dispose of the vapors passed thereto by said valve means, said disposal means comprising a venturi shaped flue, burner means supported in general registration with the smallest cross sectional area of said flue to burn off the disposed vapors, said flue aspirating ambient air during the burning of said vapors.

5. A pressure sensitive vapor collection and disposal system for use with a storage tank containing combustible material comprising:

pressure sensing means normally in a first position until the vapor pressure in the storage tank reaches a threshold pressure at which pressure said pressure sensing means is moved by the vapor pressure to a second position, valve means in communication with the tank and operable when said pressure sensing means is in its second position to pass vapors from the tank whereby the vapor pressure in the storage tank causes the vapor discharge without assistance from an aspirated carrier gas, disposal means in communication with said valve means and operable to dispose of the vapors passed thereby by said valve means, said pressure sensing means comprising a pressure swich actuated to move from said first to said second position when the vapor pressure rises to between ½ to 1 inch water column pressure.

6. The system of claim 5 wherein:

said disposal means comprises combustion chamber means wherein the discharged vapors are burned off and including flame arresting means disposed between the tank and said valve means for preventing flame flashback toward the tank.

7. The system of claim 4 including:

flow regulating means disposed between said valve means and the tank, said flow regulating means being adapted for metering the flow rate of the vapors to said disposal means and providing a controlled rate disposition of said vapors.

8. The system of claim 5 including:

flow regulating means disposed between said vale means and the tank, said flow regulating means being adapted for metering the flow rate of the vapors to said disposal means and providing a controlled rate disposition of said vapors.

9. The system of claim 5 wherein:

said pressure sensing means comprises a pressure switch actuated by the vapor pressure to move to a second position in which it closes a circuit to an electrical power supply.

said valve means being energized when said pressure switch is in its second position, and said valve means is active when energized to pass vapors to said disposal means, said disposal means comprises combustion chamber means wherein the discharged vapors are burned off, said system further comprises ignitor means energized when said pressure switch is in its second position, said ignitor means is operable to ignite the vapors passed to said combustion chamber means, flame detection means active to sense the presence of burning vapors, and interruptor means energized when said pressure switch is in said second position, said means is active if no flame is detected for de-energizing said valve means interrupting the passage of vapors to said combustion chamber means.

10. The system of claim 9 wherein:

said interrupting means further comprises timer means energized when said pressure switch is in its second position, and active for de-energizing said valve means after a pre-set time interval, and said including means responsive to said flame detector means energized when said pressure switch is in said second position, for deactivating said timer means in response to said flame detection means sensing the presence of burning vapors, prior to the de-energization of said valve means by said timer means.

11. The system of claim 10 further comprising:

temperature sensing means energized when said pressure switch is in said second position and active for sensing the presence of flame flashback toward the tank and active for de-energizing said valve means upon sensing such flame flashback.

* * * * *

UNITED STATES PATENT OFFICE

CERTIFICATE OF CORRECTION

Patent No. 3,999,936 Dated December 28, 1976

Inventor(s) Detlev Edgar Max Hasselmann

It is certified that error appears in the above-identified patent and that said Letters Patent are hereby corrected as shown below:

Column 10, Claim 8, line 22 "vale" should be --valve--.

Signed and Sealed this

Eighth Day of March 1977

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,999,936 Dated December 28, 1976

Inventor(s) Detlev Edgar Max Hasselmann

It is certified that error appears in the above-identified patent and that said Letters Patent are hereby corrected as shown below:

Column 2, Line 7, "plunged" should be --plauged--.

Column 2, Line 18, "strong" should be --storage--.

Column 3, Line 12, "reduced Thus" should be --reduced. Thus--.

Column 3, Line 21, "Pressing" should be --Pressure--.

Column 3, Line 23, "1/2 to 1 inch circuit" should say --1/2 to 1 inch water column pressure above ambient. The pressure switch completes a circuit--.

Column 7, line 37, "closd" should be -- closed --.

Signed and Sealed this

Seventeenth Day of May 1977

[SEAL]

*Attest:*

RUTH C. MASON
*Attesting Officer*

C. MARSHALL DANN
*Commissioner of Patents and Trademarks*